US007121411B2

(12) United States Patent
Aikawa

(10) Patent No.: US 7,121,411 B2
(45) Date of Patent: Oct. 17, 2006

(54) SCREEN APPARATUS

(75) Inventor: Yoshihiko Aikawa, Shizuoka (JP)

(73) Assignee: Aikawa Iron Works Co., Ltd., Shizuoka (JP)

( * ) Notice: Subject to any disclaimer, the term of this patent is extended or adjusted under 35 U.S.C. 154(b) by 496 days.

(21) Appl. No.: 10/681,169

(22) Filed: Oct. 9, 2003

(65) Prior Publication Data

US 2004/0112797 A1 Jun. 17, 2004

(30) Foreign Application Priority Data

Oct. 16, 2002 (JP) ..... 2002-301973

(51) Int. Cl.
*B07B 1/18* (2006.01)

(52) U.S. Cl. ..... 209/273; 209/306

(58) Field of Classification Search ..... 209/268, 209/269, 270, 273, 305, 306
See application file for complete search history.

(56) References Cited

U.S. PATENT DOCUMENTS

| | | | | |
|---|---|---|---|---|
| 3,437,204 A | | 4/1969 | Clarke-Pounder | |
| 3,586,172 A | | 6/1971 | Young | |
| 3,914,172 A | * | 10/1975 | McGurk et al. | 209/273 |
| 4,267,035 A | * | 5/1981 | Martin | 209/273 |
| 4,634,521 A | * | 1/1987 | Simola et al. | 209/17 |
| 4,680,108 A | * | 7/1987 | Ahs | 209/273 |
| 4,749,475 A | * | 6/1988 | Hooper | 209/273 |
| 5,221,437 A | * | 6/1993 | Sieron et al. | 162/232 |
| 5,358,637 A | * | 10/1994 | Hutzler et al. | 210/415 |
| 6,244,446 B1 | * | 6/2001 | Schmittel | 209/157 |
| 6,679,384 B1 | * | 1/2004 | Serres et al. | 209/273 |

FOREIGN PATENT DOCUMENTS

| | | |
|---|---|---|
| WO | WO 00/50690 | 8/2000 |
| WO | WO 03/104549 | 12/2003 |

* cited by examiner

*Primary Examiner*—Gene O. Crawford
*Assistant Examiner*—Matthew J. Kohner
(74) *Attorney, Agent, or Firm*—Manabu Kanesaka

(57) ABSTRACT

It is an object of the present invention to provide a screen apparatus having a function of dilute water which is suitable for a centripetal type screen which rotates inside the screen. A screen apparatus A comprises a tank 1 for receiving paper raw materials including an entrance 1*c* for the paper raw materials, a selection exit 1*d* and a foreign matter exit 1*e*, a cylindrical screen 2 fixed in the tank 1 and dividing the tank 1 into a primary chamber 1*a* and a secondary chamber 1*b*, and a stirring member 3 which is rotatably supported inside the screen 2 for stirring the paper raw materials. The entrance 1*c* for the paper raw materials and the foreign matter exit 1*e* face the primary chamber 1*a*, and the selection exit 1*d* faces the secondary chamber 1*b*, the screen 2 has a member R including an opening X facing the primary chamber 1*a* and the secondary chamber 1*b*, a water supply passage member 6 passes through the tank 1, the water supply passage member 6 includes a water supply passage 6*a* which is in communication with the opening X facing the secondary chamber 1*b* and which supplies water into the primary chamber 1*a*.

5 Claims, 4 Drawing Sheets

SCREEN APPARATUS

TECHNICAL FIELD

The present invention relates to a screen apparatus, and more particularly, to a screen apparatus having a function of providing dilute water suitable for centripetal type screen which rotates inside a screen.

BACKGROUND TECHNIQUE

There is a centripetal type screen apparatus in which a stirring member (e.g., foil, agitator or the like) is located inside a cylindrical screen provided in a tank, paper raw materials are allowed to flow from inside to outside of the screen, and foreign matters are removed from the paper raw materials.

In such a screen apparatus, when the paper raw materials flow from inside to outside of the screen and foreign matters are removed from the paper raw materials, it is easy to pass through a screen located upstream of the paper raw materials, and a screen located more downstream of the paper raw materials has higher density in the paper raw materials and it becomes more difficult to pass through such a screen and thus, selection efficiency is deteriorated.

In such a case, in the centripetal type screen apparatus which rotates outside and near the screen, it is possible to supply dilute water to a primary chamber located on the supply side of the paper raw materials.

In the centripetal type screen apparatus, however, even if dilute water is provided while passing through the tank, there is a problem that a portion of the dilute water passing through the tank does not exhibit an effect of dilution in a secondary chamber of selected paper raw materials.

DISCLOSURE OF THE INVENTION

The present invention has been accomplished in view of the problem, and the invention provides a screen apparatus having a function of providing dilute water suitable for centripetal type screen.

To achieve the above object, a first aspect of the present invention provides a screen apparatus comprising a tank for receiving paper raw materials including an entrance for the paper raw materials, a selection exit and a foreign matter exit, a cylindrical screen fixed in the tank and dividing the tank into a primary chamber and a secondary chamber, and a stirring member which is rotatably supported inside the screen for stirring the paper raw materials, wherein the entrance for the paper raw materials and the foreign matter exit face the primary chamber, and the selection exit faces the secondary chamber, the screen has a member including an opening facing the primary chamber and the secondary chamber, a water supply passage member passes through the tank, the water supply passage member includes a water supply passage which is in communication with the opening facing the secondary chamber and which supplies water into the primary chamber.

According to the first aspect, since the water supply passage member supplies water into the primary chamber, the concentration of the paper raw materials is lowered, and the selection efficiency can be enhanced and the processing amount can be increased.

According to a second aspect of the invention, in the screen apparatus of the first aspect, the member is a ring provided around the screen, and the ring is provided with a plurality of openings, and the openings facing the secondary chamber are provided with water supply passage members, respectively.

According to the second aspect, in addition to the effect of the first aspect, more water can be supplied into the primary chamber through the plurality of openings. Therefore, the concentration of the paper raw materials is lowered more, and the selection efficiency can further be enhanced and the processing amount can further be increased.

A third aspect of the invention provides a screen apparatus comprising a tank for receiving paper raw materials including an entrance for the paper raw materials, a selection exit and a foreign matter exit, a cylindrical screen fixed in the tank and dividing the tank into a primary chamber and a secondary chamber, a stirring member which is rotatably supported inside the screen for stirring the paper raw materials, the entrance for the paper raw materials and the foreign matter exit facing the primary chamber, and the selection exit facing the secondary chamber, a ring provided around the screen and having a plurality of openings facing the primary chamber and the secondary chamber, and a plurality of water supply passage members whose tip ends come into contact with the ring under pressure so that the water supply passage members are brought into communication with the openings facing the secondary chamber, the water supply passage members includes water supply passages which pass through the tank and supply water into the primary chamber.

According to the third aspect, since the tip ends of the plurality of water supply passage members come into contact under pressure with the plurality of openings facing the secondary chamber, the water supply passage members do not come into contact with the stirring member.

More water can be supplied into the primary chamber through the plurality of openings. Therefore, the concentration of the paper raw materials is lowered more, and the selection efficiency can further be enhanced and the processing amount can further be increased.

Since the tip ends of the water supply passage members come into contact with the ring, the screen is reinforced.

According to a fourth aspect of the invention, in the screen apparatus of the third aspect, the screen has first and second end surfaces which are opened to each other, the first end surface is located closer to the entrance for the paper raw materials than the foreign matter exit, the second end surface is located closer to the foreign matter exit than the entrance for the paper raw materials, and the ring is located closer to the second end surface than the first end surface, and is provided in parallel to the first end surface and the second end surface.

According to the fourth aspect, in addition to the effect of the third aspect, since the ring having the openings is located closer to the second end surface than the first end surface, the water is supplied by the water supply passage member downstream the paper raw materials where the concentration is increased. Therefore, the concentration of the paper raw materials can further be lowered and the selection efficiency can further be enhanced.

According to a fifth aspect of the invention, in the screen apparatus of the third aspect, the water supply passage member is mounted to an outer periphery of the tank such that the water supply passage member can move forward and backward.

According to the fifth aspect, in addition to the effect of the third aspect, when the screen is to be detached from the tank for exchanging or repairing the screen, since the water supply passage member which is in contact with the screen under pressure is mounted on the outer periphery of the tank such that the water supply passage member can move forward and backward, the tip end of the water supply passage member may be retreated such as to be separated from the screen, and the screen can be detached from the tank easily.

According to a sixth aspect of the invention, in the screen apparatus of the third aspect, the plurality of openings are arranged such as to be directed to a center of the tank.

According to the sixth aspect, in addition to the effect of the third aspect, water can efficiently be supplied to the rotating stirring member.

According to a seventh aspect of the invention, in the screen apparatus of the third aspect, the plurality of openings are arranged such as to be directed to a center of the tank, and the openings are opposed to each other.

According to the seventh aspect, in addition to the effect of the third aspect, water can uniformly be mixed by the rotating stirring member, and the selection efficiency can be enhanced. Since the tip ends of the plurality of water supply passage members support the screen through the ring such that the water supply passage members are opposed to each other, the screen can further be reinforced.

PREFERRED EMBODIMENTS

A screen apparatus of an embodiment of the present invention will be explained with reference to the drawings.

Figure 1:
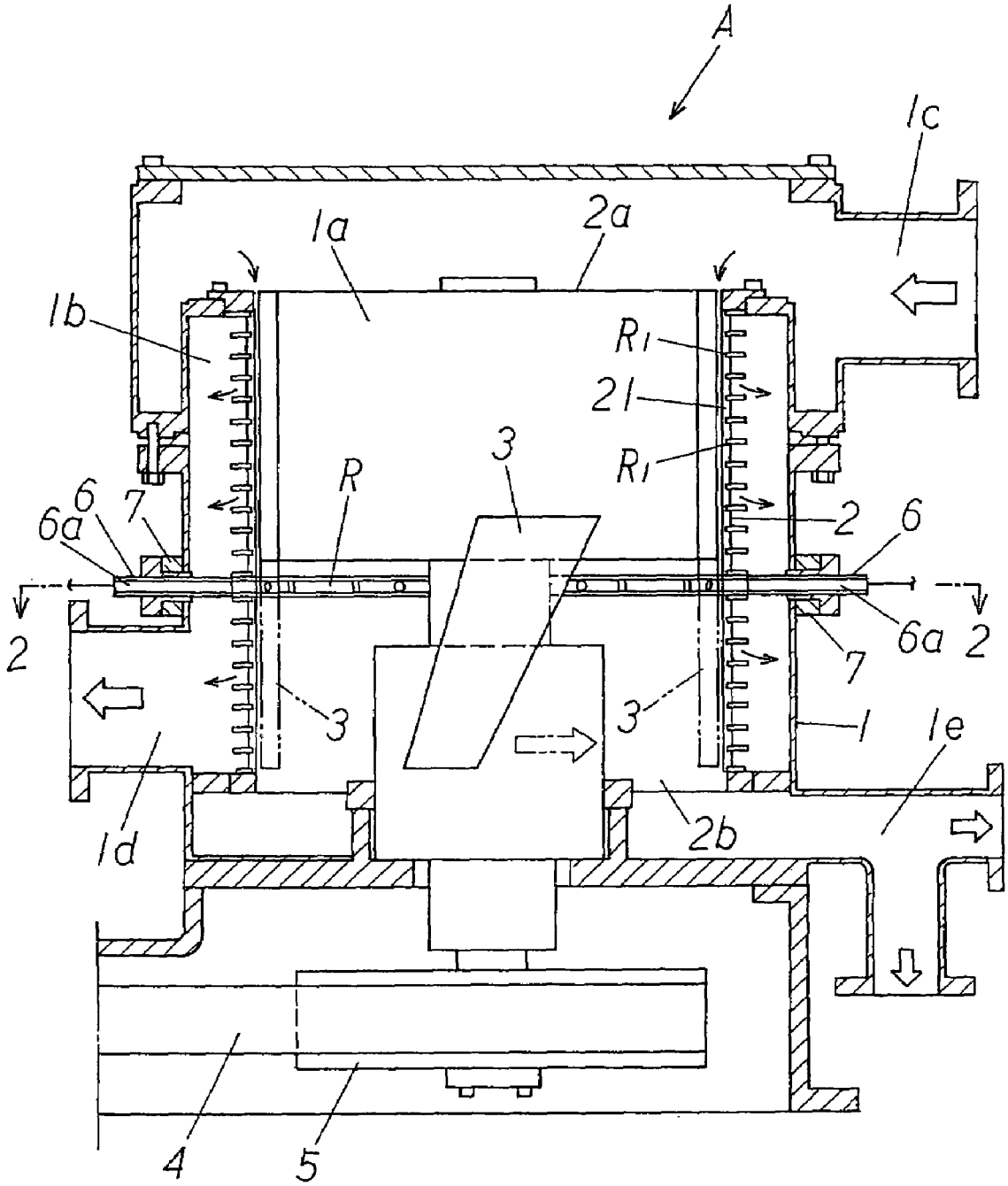
FIG. 1 is a schematic sectional view of a screen apparatus of an embodiment of the present invention.
Figure 2:
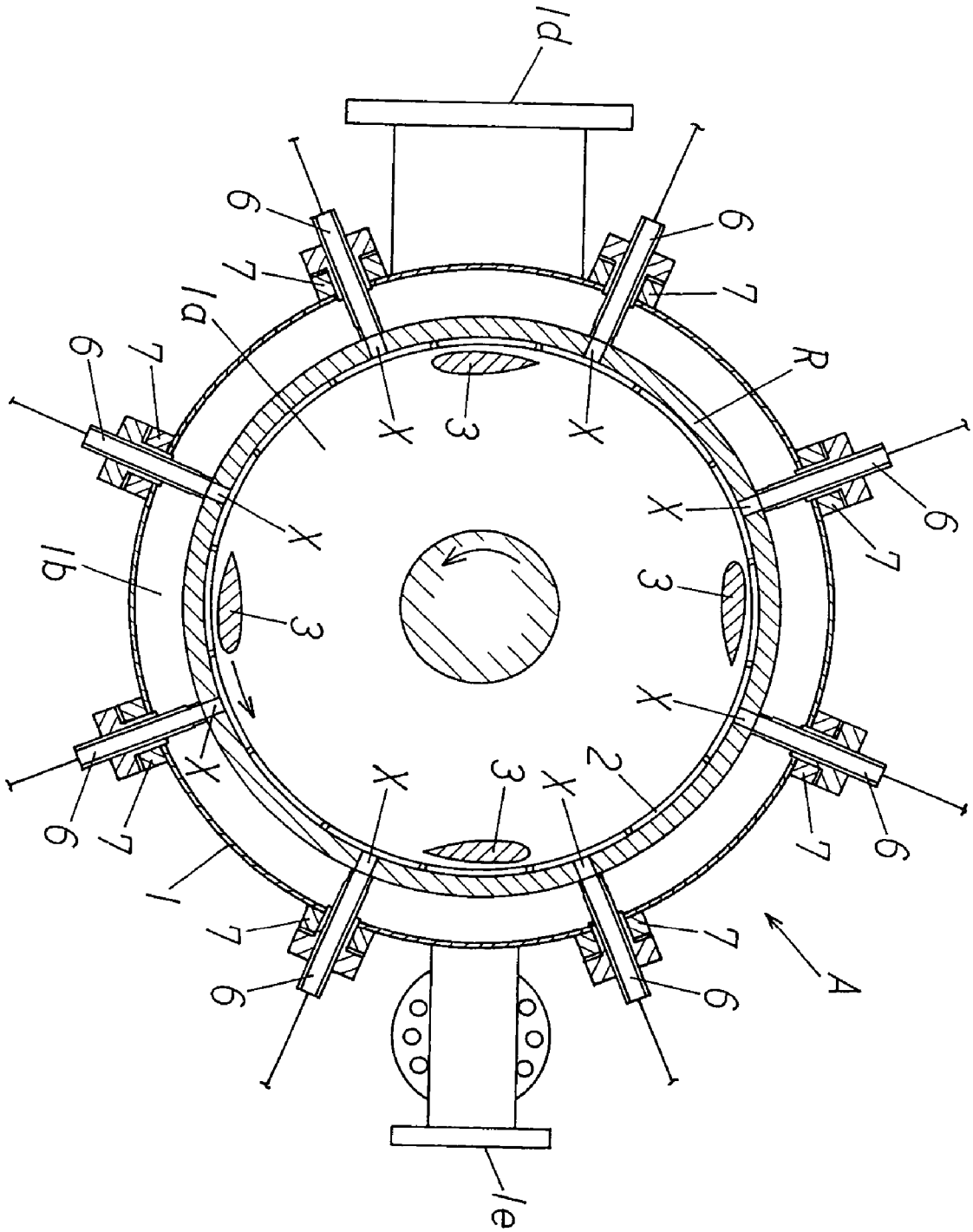
FIG. 2 is a schematic sectional view taken along a line 2—2 in FIG. 1.
Figure 3:
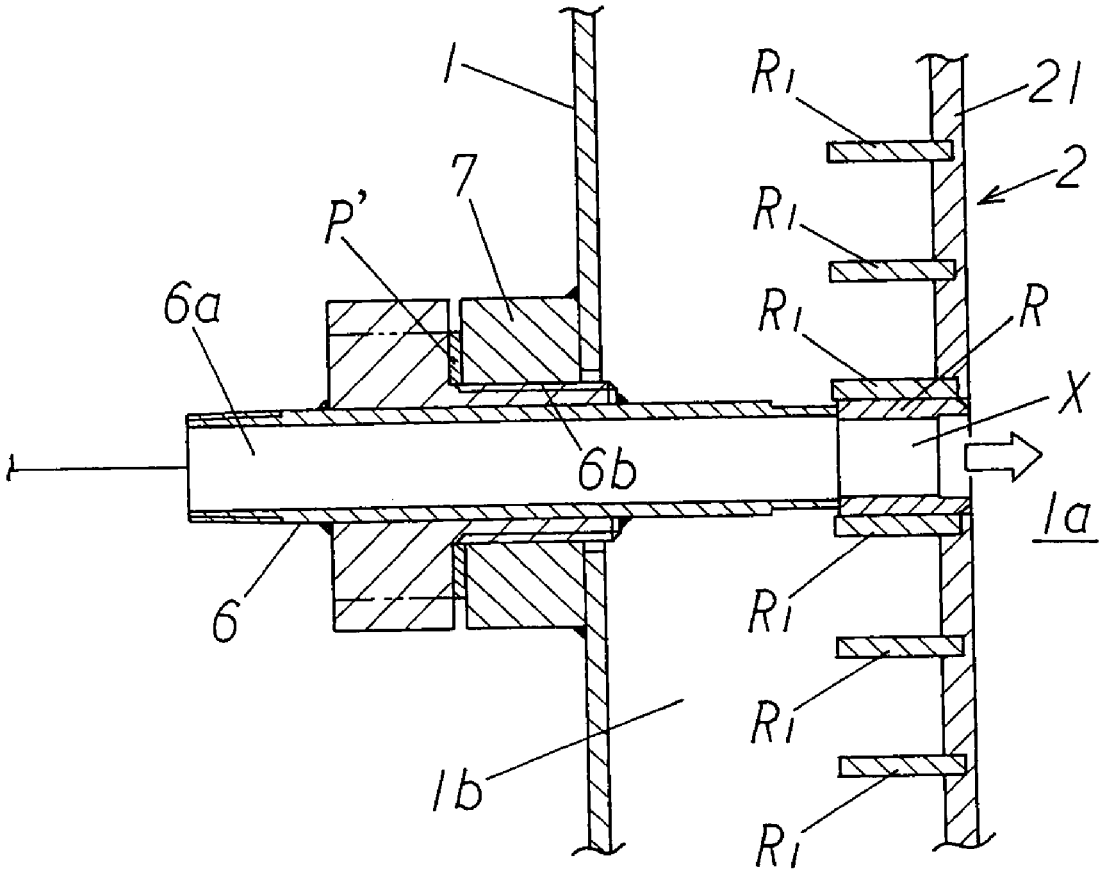
FIG. 3 is a schematic enlarged sectional view of an essential portion of the invention.

In FIGS. 1 to 3, a reference symbol A represents a screen apparatus A. The screen apparatus A is a centripetal type (outward flow type) screen in which paper raw materials are allowed to flow from inside to outside of a screen 2 to remove foreign matters from the paper raw materials.

A reference symbol 1 represents a tank having an entrance 1*c* of paper raw materials, a selection exit 1*d* and a foreign matter exit 1*e*. The tank 1 receives the paper raw materials.

A reference symbol 2 represents the cylindrical screen which divides the tank 1 into a primary chamber 1*a* located on the supply side of the paper raw materials, and a secondary chamber 1*b* located on the selection side of the paper raw materials.

The screen 2 has lateral rings $R_1$, and bars 21 engage with inner peripheries of the lateral rings $R_1$. The bars 21 are formed at distances from one another (see FIGS. 11 to 14 of Japanese Patent Application Laid-open No.H12-11792).

The entrance 1*c* and the foreign matter exit 1*e* of the paper raw materials are opposed to the primary chamber 1*a*, and the selection exit 1*d* is opposed to the secondary chamber 1*b*.

A reference symbol 3 represents a stirring member which is rotatably supported in the screen 2 for stirring the paper raw materials. The stirring member 3 is a foil, an agitator or the like for example. The stirring member 3 rotates near the screen 2. When the stirring member 3 is the foil, a front portion of the foil generates pressure with respect to the screen 2 and a rear portion of the foil generate negative pressure with respect to the screen 2, thereby cleaning a mesh of the screen 2.

A reference symbol 4 represents a belt which is rotated by a motor (not shown), and a reference symbol 5 represents a pulley. Thus, the stirring member 3 is rotated through the belt 4 and the pulley 5 by means of the motor (not shown).

A reference symbol 6 represents water supply passage members each having a water supply passage 6*a* which supplies water into the primary chamber 1*a*. The water supply passage member 6 is in communication with an opening X opposed to the secondary chamber 1*b* and passes through the tank 1. The opening X may be an opening such as a gap formed by the adjacent bars 21 of the screen 2, but it is preferable that a plurality of openings X are formed in a ring R provided around an outer periphery of the screen 2 (the ring R is fixed to the outer periphery of the screen 2). The openings X facing the secondary chamber 1*b* are provided with water supply passage members 6, respectively.

Tip ends of the plurality of water supply passage members 6 come into contact with the ring R under pressure such that the water supply passage members 6 are brought into communication with the plurality of openings X facing the secondary chamber 1*b*. When the tip ends comes into contact with the ring R under pressure, the tip ends of the water supply passage members 6 may directly come into contact with the ring R under pressure as shown in FIG. 3, or a packing P may be interposed therebetween.

As shown in FIG. 2, the openings X are arranged such as to be directed to a center of the tank 1, and the openings X are opposed to each other.

Figure 4:
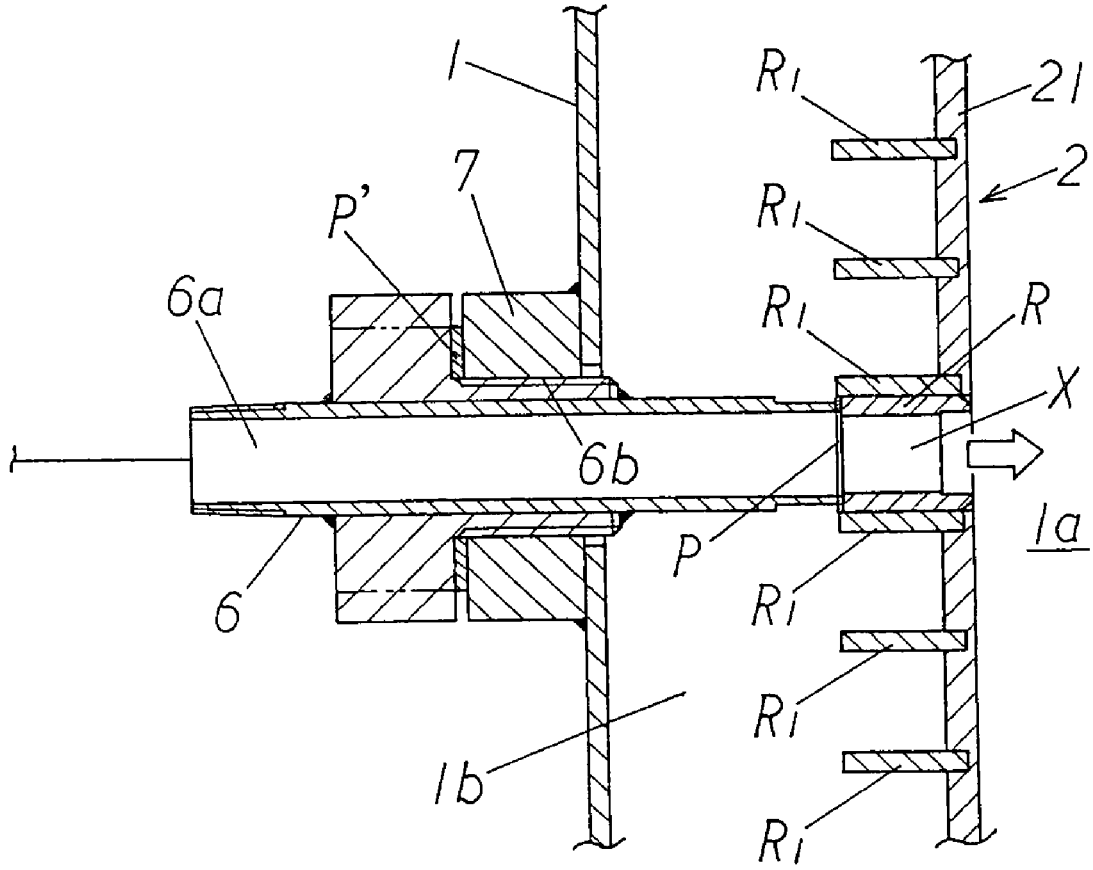
FIG. 4 is a schematic enlarged sectional view of another embodiment different from that shown in FIG. 3.

The water supply passage member 6 is mounted on a female screw 7 fixed to an outer periphery of the tank 1 such that the water supply passage member 6 can move forward and backward. That is, the water supply passage member 6 is provided at its outer periphery with a male screw 6*b* which threadedly engages with a female screw 7 fixed to the outer periphery of the tank 1. A reference symbol P' shown in FIGS. 3 and 4 represents a packing.

Opposed end surfaces 2*a* and 2*b* of the screen 2 are opened as shown in FIG. 1. The first end surface 2*a* which is one of the end surfaces is located closer to the entrance 1*c* for paper raw materials than the foreign matter exit 1*e*. The second end surface 2*b* which is the other one of the end surfaces is located closer to the foreign matter exit 1*e* than the entrance 1*c* for the paper raw materials. The ring R is located closer to the second end surface 2*b* than the first end surface 2*a* and is provided in parallel to the first end surface 2*a* and the second end surface 2*b*.

Therefore, if the paper raw materials which are to be processed flow into the primary chamber 1*a* from the entrance 1*c* for the paper raw materials, the paper raw materials are stirred by the stirring member 3, foreign matters in the paper raw materials can not pass through the screen 2, good fibers pass through the screen 2 and are discharged out from the tank 1 from the selection exit 1*d* through the secondary chamber 1*b*.

The foreign matters and the like which cannot pass through the screen 2 are discharged out from the tank 1 through the foreign matter exit 1*e*.

A portion of the screen 2 closer to the downstream of the paper raw materials has higher concentration, and it becomes more difficult for the paper raw materials to pass through the screen 2 and selection efficiency is deteriorated. However, water is supplied into the primary chamber 1*a* from the water supply passage member 6 through the opening X located downstream of the paper raw materials.

As a result, concentration of the paper raw materials is lowered, and the selection efficiency and processing amount can be enhanced.

When the screen 2 is to be detached from the tank 1 for exchanging or repairing the screen 2, since the water supply passage member 6 which is in contact with the screen 2 under pressure is mounted on the outer periphery of the tank 1 such that the water supply passage member 6 can move forward and backward, the tip end of the water supply passage member 6 may be separated from the screen 2, that is, the tip end of the water supply passage member 6 may be retreated such as to separate from the opening X (when there exists a plurality of water supply passage members 6, all of the tip ends of the water supply passage members 6 are retreated such as to separate from the opening X). When the screen 2 is separated from the tank 1, the water supply passage member 6 does not hinder, and the fixation of the screen 2 in the tank 1 is released, and the screen 2 can be detached from the tank 1 easily.

Although the member R having openings X facing the primary chamber 1*a* and the secondary chamber 1*b* is the ring in the above explanation, the member R is not limited to the ring in the present invention, and the member R having the openings X may be the screen 2 itself. In this case, the opening X is a slit or hole in the screen 2. Although the rotation shaft of the stirring member 3 of the screen apparatus A is provided in the vertical direction in the above explanation, the present invention is not limited to this, and the invention can also be applied to a screen apparatus in which the rotation shaft of the stirring member 3 is provided in the horizontal direction.

What is claimed is:

1. A screen apparatus comprising:

a tank for receiving paper raw materials and including an entrance for the paper raw materials, a selection exit and a foreign matter exit, a cylindrical screen fixed in the tank and dividing the tank into a primary chamber and a secondary chamber, and a stirring member which is rotatably supported inside the screen for stirring the paper raw materials, wherein entrance for the paper raw materials and the foreign matter exit face the primary chamber, and the selection exit faces the secondary chamber, respectively, the screen has a member including an opening facing the primary chamber and the secondary chamber, a water supply passage member passes through the tank and includes a water supply passage which is in communication with the opening facing the secondary chamber and which supplies water into the primary chamber, the water supply passage member is mounted to an outer periphery of the tank such that the water supply passage member can move toward and away from the screen wherein the member is a ring provided around the screen, the ring is provided with a plurality of openings, and each of the openings facing the secondary chamber is provided with the water supply passage member.

2. A screen apparatus comprising:

a tank for receiving paper raw materials and including an entrance for the paper raw materials, a selection exit and a foreign matter exit, a cylindrical screen fixed in the tank and dividing the tank into a primary chamber and a secondary chamber, the entrance for the paper raw materials and the foreign matter exit facing the primary chamber, and the selection exit facing the secondary chamber, a stirring member which is rotatably supported inside the screen for stirring the paper raw materials, a ring provided around the screen and having a plurality of openings facing the primary chamber and the secondary chamber, and a plurality of water supply passage members having tip ends contacting the ring under pressure so that the water supply passage members are brought into communication with the openings facing the secondary chamber, the water supply passage members including water supply passages which pass through the tank and supply water into the primary chamber, wherein each of the water supply passage members is mounted to an outer periphery of the tank such that the water supply passage member can move toward and away from the screen.

3. The screen apparatus according to claim 2, wherein the screen has first and second end surfaces which are opened and face each other, the first end surface is located closer to the entrance for the paper raw materials than the foreign matter exit, the second end surface is located closer to the foreign matter exit than the entrance for the paper raw materials, the ring is located closer to the second end surface than the first end surface, and is provided in parallel to the first end surface and the second end surface.

4. The screen apparatus according to claim 2, wherein the plurality of openings are arranged to be directed to a center of the tank.

5. The screen apparatus according to claim 2, wherein the plurality of openings are arranged to be directed to a center of the tank, and the openings are opposed to each other.

* * * * *